United States Patent [19]

Carrier et al.

[11] 4,433,977

[45] Feb. 28, 1984

[54] SITU PROCESS FOR MAKING MULTIFUNCTIONAL FUEL ADDITIVES

[75] Inventors: Robert C. Carrier, Austin; Billy R. Allen, Bridge City, both of Tex.

[73] Assignee: Texaco Inc., White Plains, N.Y.

[21] Appl. No.: 303,735

[22] Filed: Sep. 21, 1981

[51] Int. Cl.[3] ..... C10L 1/22

[52] U.S. Cl. ..... 44/60; 44/71; 562/561; 260/404.5; 252/392

[58] Field of Search ..... 44/60, 71; 562/561; 260/404.5; 252/392

[56] References Cited

U.S. PATENT DOCUMENTS 4,207,079 6/1980 Herbstman et al. ..... 44/71

*Primary Examiner*—Charles F. Warren

*Assistant Examiner*—Y. Harris-Smith

*Attorney, Agent, or Firm*—Carl G. Ries; Robert A. Kulason; Henry W. Archer

[57] ABSTRACT

Disclosed is an in situ or "one pot" process for making a fuel additive comprising reacting an excess of at least one N-primary alkylalkylene diamine with maleic anhydride in the presence of from 20 to 36 weight percent of a mineral oil reaction diluent at a temperature ranging from ambient to about 225° F. and recovering a product containing a primary aliphatic hydrocarbon amino alkylene substituted asparagine, an N-primary alkylalkylene diamine in the reaction oil with the product having a by-product succinimide content not in excess of 1.0 weight percent, based on the weight of asparagine present.

10 Claims, No Drawings

SITU PROCESS FOR MAKING MULTIFUNCTIONAL FUEL ADDITIVES

BACKGROUND OF THE INVENTION

1. Field of the Invention

This invention is concerned with a multifunctional fuel additive which is useful when employed in a liquid hydrocarbon fuel for an internal combustion engine. Owing to its reduced imide content, the additive does not degrade the water separation properties of the fuel.

2. Description of the Prior Art

The most pertinent art relating to this invention is coassigned U.S. Pat. No. 4,207,079, issued June 10, 1980. Said patent discloses and claims primary aliphatic hydrocarbon asparagine compounds possessing a high level of corrosion inhibition and carburetor detegency properties. The disclosure of said patent is incorporated herein by reference.

In the process disclosed in said patent, approximately two moles of a N-primary alkylalkylene diamine are reacted with a mole of maleic anhydride at a temperature ranging from about room temperature up to about 110° C. maximum, preferably from about 60° to 100° C. The reaction preferably is carried out in a mineral reaction diluent and the products are then blended, without separation or purification, with about a 33 weight percent excess of the diamine thereby forming an additive containing about 33 weight percent asparagine as the active ingredient, about 33 weight percent of diamine and about 34 weight percent of mineral oil. In the process used for preparing the asparagine there are also results from 5 to 10 percent by weight of by-product succinimides which are not separated therefrom to minimize production costs. The present invention constitute an improvement over that of the above-mentioned patent and is based on the unexpected discovery that preparing the asparagine compound in the presence of excess diamine reduces the succinimide content and improves the water separation characteristics of the additive.

SUMMARY OF THE INVENTION

The present invention provides an in situ process for making a multifunctional fuel additive comprising reacting from 4.0 to 4.5 moles of an N-primary alkylalkylene diamine with one mole of maleic anhydride in the presence of from 20 to 36 weight percent of a mineral oil reaction diluent at a temperature ranging from ambient to about 225° F. and recovering a product containing a primary aliphatic hydrocarbon amino alkylene substituted asparagine and excess N-primary alkylene diamine in the reaction oil and having a by-product succinimides content not in excess of 1.0 weight percent, based on the weight of asparagine present.

Use of excess diamine in the process suppresses the formation of succinimides yielding a product having better handling characteristics and water separation properties. The invention also provides a motor fuel containing from about 0.0002 to 0.2 weight percent of the above additive.

DESCRIPTION OF BEST MODE OF PRACTICING THE INVENTION

Maleic anhydride is an article of commerce and is preferably used here in its unsubstituted form. However, derivatives thereof where substitutable hydrogens have been replaced by substituents which are inert under the reaction conditions including alkyl, haloalkyl, nitro, cyano, also are suitable for use as reactants herein. The products resulting from the reaction of such substituted anhydrides with diamines are equivalent for the purpose of this invention to those obtained with unsubstituted anhydrides.

The N-primary alkyl-alkylene diamine reactant used in this process is represented by the formula:

$$R,R'—N—C_3H_6—NH_2$$

in which R is a primary aliphatic hydrocarbon radical having from about 6 to 30 carbon atoms and R′ is hydrogen or a methyl radical. Preferred N-primary alkyl-alkylene diamines are those in which R is a straight chain primary alkyl radical and R′ is hydrogen. As employed herein the term N-alkyl-alkylene diamine covers both N-monoalkyl-alkylene diamine and the N-dialkyl-alkylene diamine structure when R′ is a methyl radical.

The most preferred N-alkyl-alkylene diamines are represented by the formula:

$$R—NH—CH_2CH_2—CH_2—NH_2$$

in which R is a straight chain primary alkyl aliphatic hydrocarbon radical having from 16 to 20 carbon atoms.

Examples of suitable N-alkyl-alkylene diamines include N-oleyl-1,3-propane diamine, N-lauryl-1,3-propane diamine, N-stearyl-1,3-propane diamine and N-dodecyl-1,3-propane diamine.

The reaction diluent used can be any available mineral oil but preferably is an oil having an SUS at 100° F. of 100 and a specific gravity of 0.88.

Preferred process parameters are as follows:

| | |
|---|---|
| Diamine/maleic anhydride ratio | 4.41/1.00 |
| Diamine charge time | 2.0 hours |
| Diamine charge temperature | 150–190° F. |
| Reaction time | 2.0 hours |
| Reaction temperature | 195–205° F. |
| Reaction pressure | 0–5 psig |

In carrying out the present process, the reaction diluent is supplied to a closed reactor and solid maleic anhydride is charged therein at ambient temperature (75° F.). The reactor's vapor space is purged with nitrogen and the contents are heated to 150° F. with the reactor mixer off to melt the maleic anhydride. The mixer is turned on and the diamine is charged over a two hour period while maintaining the bulk liquid temperature below 190° F. Molten maleic anhydride is also satisfactory for use in the process. When molten maleic anhydride is used, the processing sequence is as follows: (1) The reaction diluent is supplied to a closed reactor and the reactor mixer is turned on. (2) The reaction diluent is heated to around 150° F. and the reactor vapor space is purged with nitrogen during the heat-up. (3) Molten maleic anhydride is charged to the preheated diluent oil and (4) The diamine is charged over a two hour period, while maintaining the bulk liquid temperature below 190° F. Upon completion of the diamine charge, the reactor contents are held at 195°–205° F. for about a 2 hour reaction period. The product is then cooled to about 125° F. and filtered on a polish filter.

The asparagine product is represented by the formula:

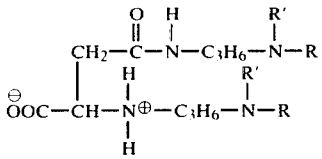

in which R is a primary aliphatic hydrocarbon radical having from about 6 to 30 carbon atoms, R′ is hydrogen or a methyl radical. Preferably R is a straight chain radical having from 16 to 20 carbon atoms.

Examples of specific compounds of the invention produced in this reaction include the following:

N,N′-di-(3-n-oleylamino-1-propyl)asparagine
N,N′-di-(3-n-dodecylamino-1-propyl)asparagine
N,N′-di-(3-n-octylamino-1-propyl)asparagine
N,N′-di-(3-stearylamino-1-propyl)asparagine
N,N′-di-(3-decylamino-1-propyl)asparagine
N,N′-di-(3-laurylamino-3-propyl)asparagine
N,N′-di-(3-behenylamino-1-propyl)asparagine Mixtures of these produced by reacting more than one diamine with maleic anhydride also are suitable.

The process of the invention is illustrated in tabular form below. Examples of material balances for the initial bench scale and 30 gallon pilot unit reactor batches of additive are as follows:

| | Bench Scale | 30 Gallon Pilot Unit |
|---|---|---|
| Charge Weight, gms (lbs) | | |
| Oil (100 EPSHF)[2] | 1347.2 | (60.7) |
| Maleic Anhydride (MAA) | 157.0 | (7.2) |
| Diamine[1] | 2470.0 | (109.9) |
| Total | 3974.2 | (177.8) |
| Recovery Weight, gms (lbs) | | |
| Product | 3970.0 | (175.1) |
| Filtration Loss | — | (1.2) |
| Samples | — | (1.5) |
| Total | 3970.0 | (177.8) |
| Overall Recovery, Wt % (basis reactants) | 99.9 | 100.0 |

[1]N—oleyl-1,3-propanediamine.
[2]SUS at 100° F. of 100; sp. gr. 0.88.

Time-Temperature Cycle

Time-temperature cycle for the initial bench scale and 30 gallon pilot unit reactor batches of product are presented below:

| Equipment Run No. | | Bench Scale 20327 | 30 Gallon Pilot Unit 20351 |
|---|---|---|---|
| (1) Charge 100 EPSHF & MAA, | Time, hrs | 0.25 | 0.50 |
| | Temp, F. | 77 | 85-95 |
| (2) Purge W/$N_2$ and Heat-Up | Time, hrs | 2.0 | 2.25 |
| | Temp, F. | 77-151 | 96-150 |
| (3) Charge Diamine | Time, hrs | 2.0 | 2.8 |
| | Temp, F. | 150-196 | 150-190 |
| (4) Heat-up | Time, hrs | 1.0 | 0.5 |
| | Temp, F. | 196-200 | 190-200 |
| (5) Reaction | Time, hrs | 2.0 | 2.0 |
| | Temp, F. | 199-202 | 196-202 |
| (6) Cooldown | Time, hrs | 4.5 | 2.5 |
| | Temp, F. | 200-110 | 202-125 |
| (7) Filter | Time, hrs | [a] | 0.1 |
| | Temp, F. | — | 125 |
| | Total Time, hrs | 11.75 | 10.65 |

[a]Product was not filtered.

-continued

Product Test Data

| Test | Method | Bench Scale | 30 Gallon Pilot Unit |
|---|---|---|---|
| Appearance | Visual | Bright & Clear | Bright & Clear |
| Water, Wt % | D1744 | 0.3 | 1.2 |
| Lumetron Turbidity | ST-289 | 0.5 | 1.0 |
| Pour, F | D97 | — | −10 |
| Sp. Gr. 60/60 F | ST-202 | 0.8929 | 0.8888 |
| Kin. Vis. cST at 40 C. | D445 | 57.40 | 50.70 |
| at 100 C. | D445 | 8.80 | 8.30 |
| TBN | ST-312 | 178 | 180 |
| TAN | D974 | 17.3 | 15.2 |
| Flash, COC, F | D92 | 310 | 375 |
| Color, ASTM | D1500 | 4.0 | 3.0 |
| Nitrogen, Wt % | ST-374 | 5.7 | 6.2 |

The base fuel, which is useful for employing the additive of the invention, is a mixture of hydrocarbons boiling in the gasoline boiling range. This base fuel may consist of straight-chain or branched-chain paraffins, cycloparaffins, olefins, and aromatic hydrocarbons, and any mixture of these. The base fuel can be derived from straight-run naphtha, polymer gasoline, natural gasoline or from catalytically reformed stocks and boils in the range from about 80° to 450° F. The composition and the octane level of the base fuel are not critical and any conventional motor fuel base can be employed in the practice of this invention.

In general, the additive of the invention is added to the base fuel in a minor amount, i.e., an amount effective to provide both corrosion inhibition and carburetor detergency to the fuel composition. The additive is effective in an amount ranging from about 0.0002 to 0.2 weight percent based on the total fuel composition. An amount of the neat additive ranging from about 0.001 to 0.01 weight percent is preferred, with an amount from about 0.001 to 0.003 being particularly preferred, the latter amounts corresponding to about 3 to 8 PTB (pounds of additive per 1000 barrels of gasoline) respectively.

The fuel composition of the invention may contain any of the additives normally employed in a motor fuel. For example, the base fuel may be blended with an anti-knock compound, such as a methyl-cyclopentadienyl manganese tricarbonyl or tetraalkyl lead compound, including tetraethyl lead, tetramethyl lead, tetrabutyl lead, and chemical and physical mixtures thereof, generally in a concentration from about 0.025 to 4.0 cc. per gallon of gasoline. The tetraethyl lead mixture commercially available for automotive use contains an ethylene chloride-ethylene bromide mixture as a scavenger for removing lead from the combusion chamber in the form of a volatile lead halide.

The fuel composition of the invention prevents or reduces corrosion problems during the transportation, storage and the final use of the product. The fuel of the invention also has highly effective carburetor detergency properties. When a fuel of the invention is employed in a carburetor which already has a substantial build-up of deposits from prior operations, a severe test of the carburetor detergency property of a fuel composition, this motor fuel is effective for removing substantial amounts of the preformed deposits.

It is to be understood that the examples presented herein are intended to be merely illustrative of the invention and not as limiting it in any manner; nor is the invention to be limited by any theory regarding its operability. The scope of the invention is to be determined solely by the appended claims.

What is claimed is:

1. An in situ process for making a multifunctional fuel additive comprising reacting from 4.0 to 4.5 moles of at least one N-primary alkylalkylene diamine with one mole of maleic anhydride in a mineral oil reaction diluent at a temperature ranging from ambient to 225° F. and recovering a product containing a primary aliphatic hydrocarbon amino alkylene substituted asparagine; excess N-primary alkylalkylene diamine and said diluent, said product having a by-product succinimides content not in excess of 1.0 weight percent based on weight of asparagine present.

2. The process of claim 1 carried out in 20 to 36 weight percent of said diluent.

3. The process of claim 1 wherein said asparagine has the formula:

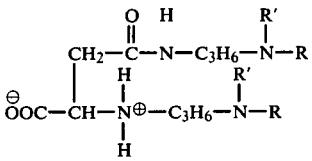

in which R is a primary aliphatic hydrocarbon radical having from about 6 to 30 carbon atoms and R′ is hydrogen or a methyl radical.

4. The process of claim 3, wherein said asparagine has R being a straight chain primary aliphatic hydrocarbon radical having from 16 to 20 carbon atoms.

5. The process of claim 3, wherein said asparagine is selected from the group consisting of:

N,N′-di-(3-n-oleylamino-1-propyl) asparagine,
N,N′-di-(3-n-dodecylamino-1-propyl)asparagine,
N.N′-di-(3-n-octylamino-1-propyl)asparagine,
N,N′-di-(3-stearylamino-1-propyl)asparagine, and
N,N′-di-(3-laurylamino-1-propyl)asparagine and mixtures thereof.

6. The process of claim 1, wherein there is used a diamine/maleic anhydride ratio of 4.41/1.00.

7. The process of claim 1, wherein said diamine and said diluent are charged into a reactor over a two hour period and said diamine is dissolved in said diluent by heating at 150° to 190° F.

8. The process of claim 1, wherein said diamine and said maleic anhydride are heated in said diluent for about 2 hours at a temperature of 195° to 205° F. under a pressure of 0 to 5 psig.

9. The process of claim 1 wherein said diluent is supplied to a closed reactor, heated to around 150° F. while the reactor vapor space is purged with and mixed with an inert gas, molten maleic anhydride is charged and mixed with the thus preheated diluent and said diamine is charged into said reactor while maintaining the temperature below about 190° F.

10. A motor fuel composition comprising a mixture of hydrocarbons in the gasoline boiling range containing from about 0.0002 to 0.2 wt% of an additive prepared by reacting from 4.0 to 4.45 moles of at least one N-primary alkyl alkylene diamine with one mole of maleic anhydride in a mineral oil reaction diluent at a temperature ranging from ambient to 225° F. and recovering a product containing a primary aliphatic hydrocarbon aminoalkylene substituted asparagine; excess N-primary alkyl alkylene diamine and said diluent, said additive having a by-product succinimide content not in excess of 1.0 wt% based on the weight of asparagine present.

* * * * *